US008297095B2

(12) United States Patent
Wagner

(10) Patent No.: US 8,297,095 B2
(45) Date of Patent: Oct. 30, 2012

(54) METHOD AND APPARATUS FOR IMPROVING MECHANICAL PROPERTIES OF MAGNETICALLY ACTIVATABLE MATERIALS

(75) Inventor: Hans-Roland Wagner, Metzingen (DE)

(73) Assignee: UNGERER GmbH + Co. KG, Pforzheim (DE)

( * ) Notice: Subject to any disclaimer, the term of this patent is extended or adjusted under 35 U.S.C. 154(b) by 603 days.

(21) Appl. No.: 12/585,105

(22) Filed: Sep. 3, 2009

(65) Prior Publication Data

US 2010/0050722 A1 Mar. 4, 2010

(30) Foreign Application Priority Data

Sep. 4, 2008 (DE) ..... 10 2008 045 743

(51) Int. Cl.
*B21D 1/00* (2006.01)
*H01F 1/00* (2006.01)

(52) U.S. Cl. ..... 72/54; 72/430; 72/707

(58) Field of Classification Search ..... 72/54, 56, 72/430, 707
See application file for complete search history.

(56) References Cited

U.S. PATENT DOCUMENTS 3,928,657 A 12/1975 Armstrong et al.
4,911,950 A * 3/1990 Horikoshi et al. ..... 427/549

FOREIGN PATENT DOCUMENTS

| | | |
|---|---|---|
| DE | 2236247 | 2/1974 |
| DE | 690 03 834 T2 | 2/1994 |
| JP | 59-189015 | 10/1984 |
| JP | 7-256341 | 10/1995 |
| JP | 9-108736 | 4/1997 |
| JP | 2001-205325 | 7/2001 |
| JP | 2007-237193 | 9/2007 |

* cited by examiner

*Primary Examiner* — David B Jones
(74) *Attorney, Agent, or Firm* — Rabin & Berdo, P.C.

(57) ABSTRACT

A method for improving mechanical properties of a magnetically activatable material for reducing ripples in the magnetically activatable material. The method includes conveying the magnetically activatable material using at least one conveying device through a processing region, and applying a force on the magnetically activatable material in the processing region to deform the magnetically activatable material. The force is contactlessly applied by a plurality of magnet groups that form a plurality of magnetic fields, and which are arranged in a material flow direction side by side or one behind another. The plurality of magnetic fields are applied in or opposite to the material flow direction, and travel along one of the plurality of magnet groups or between two of the plurality of magnet groups.

33 Claims, 1 Drawing Sheet

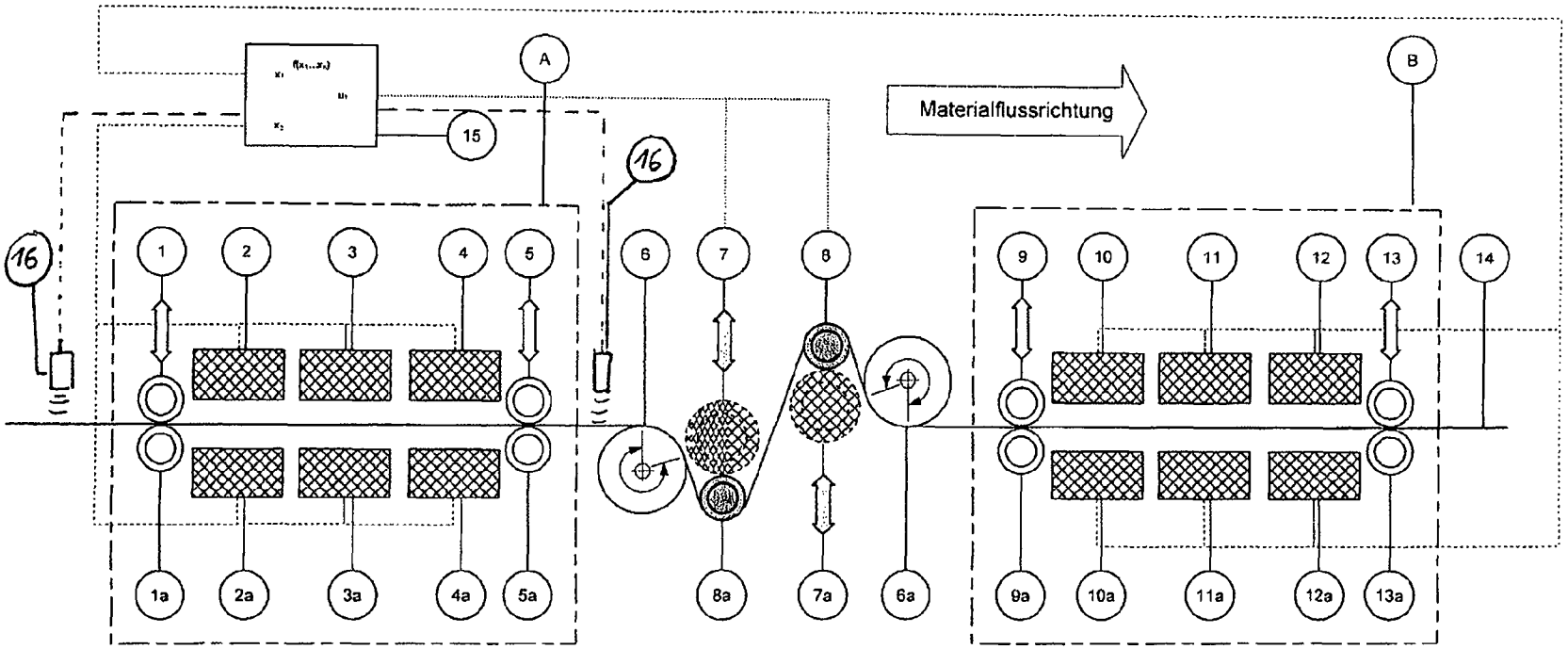
Materialflussrichtung
A
B
1
2
3
4
5
6
7
8
9
10
11
12
13
14
15
16
16
1a
2a
3a
4a
5a
6a
7a
8a
9a
10a
11a
12a
13a

METHOD AND APPARATUS FOR IMPROVING MECHANICAL PROPERTIES OF MAGNETICALLY ACTIVATABLE MATERIALS

CROSS-REFERENCE TO RELATED APPLICATIONS

The present application claims the priority of the German Patent Application 10 2008 045 743.4, which was filed on Sep. 4, 2008, the content thereof being hereby expressly included in the subject matter of the present application.

BACKGROUND OF THE INVENTION

1. Field of the Invention

The invention relates to a method and an apparatus for improving mechanical properties of a magnetically activatable material, in particular for reducing ripples in metallic materials such as metal bands or metal sheets.

2. Description of the Related Art

Metal bands or metal sheets, hereinafter called materials, are finished with known treatment machines for band or sheet materials in order to achieve required material properties in the material. The finishing generally designates a process for generating changed properties in materials. These band or sheet treatment machines are known in the most varied forms and are used to bring about required material properties. They are used in band treatment or further processing lines, such as pickling lines, annealing lines, coating lines, roller mill and conditioning lines, shearing lines, stretcher and roller levelling systems or the like and combinations of different band treatment and further processing lines.

After their production, metal bands or metal sheets basically have material defects, which are characterised as edge, centre and/or longitudinal ripples. Likewise, combinations or superimpositions of edge, centre and/or longitudinal ripples are possible and lead to the most varied material defects. These material defects are generally known and appear more or less intensely as ripples in the material.

For further processing of these defective materials, these have to be flattened. Flattening describes a technical process for minimising existing ripples in the material and is generally carried out by known levelling machines or known stretcher levelling systems.

Basically, levelling machines are used for the flattening. Each levelling machine basically consists of a stable frame, in which levelling rollers are used. The levelling rollers are accommodated in a suitable device, in each case at the top and bottom inside the levelling machine. A suitable material guidance opening at the inlet and outlet of the levelling machine allows material transportation through the levelling machine and therefore through the levelling rollers. The upper and lower levelling rollers, also called a levelling roller set, are mounted together at fixed intervals and arranged one behind the other. The spacing between the inlet-side top and bottom set of levelling rollers, also known as the opening ratio, can be adjusted to transport different material thicknesses through the levelling machine and to be able to process them. The opening ratio is taken to mean the spacing between the inlet-side top and bottom levelling rollers in relation to the material thickness.

The material to be processed is continuously conveyed into the levelling machine through the material supply opening. The introduction of the material into the levelling machine and the adjustment of the opening ratio produces a force-transmitting contact between the material and the sets of levelling rollers arranged at the top and bottom. When the material is transported through the levelling machine, the material is subject to a temporally limited alternating bending stress. The transport section is thus determined by the number of predetermined levelling rollers, in which the material is forcibly guided around the individual top and bottom levelling rollers and subjected to a mechanical bending.

This alternating bending stress deforms the material at the edge regions of the surface by alternating tensile and pressure loads as a function of the opening ratio of the top and bottom sets of levelling rollers. Depending on the opening ratio, these tensile and pressure loads decrease to a greater or lesser degree in the depths of the material. A large opening ratio reduces and a small opening ratio increases the alternating bending stress of the material. If the tensile stress at the edge regions of the material surface locally reaches a limit value characteristic of the material, which is known as the yield point of the material, the material expands at these points and a stretching remains in the material, which appears as a length change.

A ripple basically present beforehand in the material is improved to a greater or lesser degree by the temporally limited alternating bending stress. This process is generally described as a levelling process.

In terms of technology, limits are set for a complete elimination of ripples in the material by the use of levelling machines. Because of the materials and material dimensions occurring today, such as the material width and material thickness, as well as the new high-strength materials to be expected in the future, the mechanical stabilities of a levelling machine are no longer adequate for targeted quality improvement of the materials, in particular to eliminate ripples in materials, in the currently known levelling machines. In addition, mechanical limits are produced on levelling machines owing to a limited opening ratio of the levelling rollers and the spacing between top and bottom sets of levelling rollers for high-strength and thin classes of material. A flattening of the materials is no longer possible here.

In general, a distinction is made between driven and non-driven levelling machines. In the driven levelling machines, the levelling rollers are driven axially by a suitable mechanical coupling to a levelling roller drive unit and the material is transported through the driven levelling rollers, which use force to clamp the material, inside the levelling machine.

In the case of the non-driven levelling machines, the material is forcibly conveyed by the levelling machine with the aid of a suitable mechanical material supply or withdrawal device, which is arranged directly in front of or behind the levelling machine.

In the case of driven and non-driven levelling machines, the material is continuously loaded with shearing and contact forces on the inlet side because of the spacing and the spatial adjustment of the levelling rollers arranged at the top and bottom. In this case, in the supply region of a levelling machine, the spacing between the top and bottom levelling rollers is significantly smaller than in the outlet region. The shearing and contact forces strongly prevailing in the supply region of a levelling machine as a result are no longer present in the outlet region of the levelling machine. Because of the declining shearing and contact forces, a constant frictional engagement cannot form between the levelling rollers and the material over the entire levelling process. An adequate frictional engagement between the levelling rollers and the material is absolutely required, however.

Because of the continuously decreasing frictional engagement in the outlet region of the levelling machine between the material and the levelling rollers, substantial surface and material defects are formed on the surface of the material in the form of scratches, furrows, or streaks, which are formed because of the decreasing or even absent frictional engagement. These surface and material defects are substantial quality deficiencies.

In particular in the case of soft materials with small material thicknesses of less than 200 μm, considerable difficulties already arise in avoiding these surface and material defects. Surface and material defects occur in particular in the levelling process when the material passes by a levelling roller arrangement as the result of an inadequate frictional engagement and the alternating bending between the material virtually disappears here and slipping of the material on the levelling rollers sharply increases due to an inadequate frictional engagement. In addition, an inadequate frictional engagement impairs the long-term, improvement required in the ripple in the material substantially. This is all the more the case as, for various material thicknesses, the rigid mechanical arrangement of the sets of levelling rollers cannot be changed and the spacing between the top and the bottom sets of levelling rollers is only varied within limits.

A treatment machine of this type for band or sheet materials is known from DE 690 03 834 T2. The material is guided through between levelling rollers and pressed together there. The force is produced magnetically, in that a main roller consists of non-magnetic material and is hollow, so that a magnet can be arranged within the main roller. The press roller cooperating therewith consists of a magnetic material, so the press roller is driven against the main roller by means of the magnet in order to produce the force, which is required there, for rolling. Thus, the use of magnets in conjunction with a roller device is known, but not for contactless material finishing. An ultrasonic device is not proposed there.

According to the current prior art, an inadequate frictional engagement between the material and the levelling rollers can only be counteracted in that the material is not subject to any contact of any kind with levelling rollers during the levelling process.

SUMMARY OF THE INVENTION

Proceeding from the described prevailing technical problems of avoiding surface and material defects on materials by the use of levelling machines and achieving an improvement in the ripple on metal bands and metal sheets, the present invention is based on the object of providing a levelling process or a material finishing process for metal bands and metal sheets, which meets the requirements of all mutually-linked processing operations positioned upstream and downstream.

This object is achieved by a method and an apparatus for improving mechanical properties of magnetically activatable materials with the features of claim 1 or the features of claim 17.

To achieve the object it is proposed according to the invention that the levelling machine, which is used in a band treatment system, a further treatment system or the like is replaced by a method and an apparatus, which no longer requires a mechanical contact of levelling rollers with the material for a levelling process in a levelling machine.

It is possible through the application of magnetic forces, to subject the material to a partial longitudinal extension to the edge of the yield point of the material in order to minimise and reduce ripples, which appear in the form of edge, centre and/or longitudinal undulations in the material. For this purpose, the material is either brought into the region of at least one correspondingly activatable magnetic field or, in addition, subjected to an ultrasonic source. Both individual magnets of the at least one magnet group or a plurality of magnet groups can be controlled individually just as much as the ultrasonic devices. Owing to the use of spatially distributed individually electrically connectable and travelling magnetic fields, a direct mechanical contact with material is completely ruled out and surface and material defects no longer occur on the material. In conjunction with the ultrasonic devices, which preferably still abut the material, surface and material defects no longer occur, as, in this case, no force-fit connection is required. This is reliably ensured merely by the conveying devices.

The core of the invention is to subject metal bands or metal sheets, basically furthermore called materials, to at least one spatially distributed and travelling magnet field, which leads to a partial longitudinal extension of the material up to the edge of the yield point in order to minimise and reduce ripples, which appear in the form of edge, centre and/or longitudinal undulations in the material.

The production of a magnetic field is implemented by a suitable, high-power, electrically adjustable power source, which produces different magnetic field strengths. The magnetic field is spatially present at the poles of the magnet and passes through the material located in the magnetic field.

A plurality of magnets located next to and/or behind one another and which can be controlled individually are called a magnet group. The latter produce a spatial magnetic field extended in a planar manner and pass through a material part corresponding to the magnet group face, which is located in the magnetic field spatially extended in a planar manner.

Because of the spacing of magnets located next to one another and/or behind one another and a forced guidance device arranged in front of and behind the magnetic field for the material transport within the magnetic field, a contact between the material and the magnetic poles is completely ruled out.

A temporally variable and travelling magnetic field inside a magnet group, which is achieved by electrical excitation of the individual magnets within a magnet group and moves relative to the material, produces a considerable force component in the material, which leads to a local material deformation and therefore structural change in the material. By increasing the magnetic field energy, this structural change can be increased to the yield point of the material and leads to a targeted elongation and therefore improvement in the ripple in the material.

At locations in the material at which ripples locally prevail, corresponding magnet groups are electrically switched in such a way that a local elongation to the yield point of the material is immediately set and the locally present ripples in the material are eliminated. The force component required for this, which is required to produce an elongation in the material, depends on the material dimensions, the degree of ripple and the local position as well as the specific material properties. The spatial arrangement of the magnet groups is determined on the basis of material dimensions and material properties.

In a further configuration of the invention it is provided to use in addition an ultrasonic device in the direction of material flow or material transport directly in front of or behind at least one magnet group.

The ultrasonic device preferably consists of two independent rollers which are freely rotatable and height-adjustable, in which ultrasonic sources are used.

The surfaces of the rollers are coated with a sound-permeable coating, through which the sonic energy passes virtually without loss from the sound source by way of the sound-permeable coating into the material. The material is deflected by means of the rollers, which can be height-adjusted, by suitably arranged looping rollers, which are in each case arranged in front of and behind the rollers. The looping rollers in conjunction with the height-adjustable position of the rollers force a surface contact between the sound-permeable coating of the rollers and the material, which ensures an introduction of the sonic energy into the material. Attached in the interior of the rollers, in accordance with the material width, is a number of ultrasonic sources, which can be electrically controlled individually.

The individual, electrically adjustable ultrasonic sources produce sound amplitudes of certain excitation frequencies. The sound amplitudes and excitation frequencies of the individual ultrasonic sources depend on the locally prevailing ripples or residual ripples in the material and the specific properties.

A locally adjustable sonic energy density of the ultrasonic waves eliminates existing ripples or residual ripples, in that the material is forcibly guided over a deflection roller and a surface contact with the roller is ensured at all times and thus a reliable introduction of the sonic energy into the material is made possible.

The top and bottom side of the material are alternately supplied with sonic energy by a special arrangement of the rollers, and this leads to an additional improvement in the ripple of the material. Thus, energy losses with an only one-sided introduction of the sonic energy are avoided.

In addition, the possibility exists of detecting the surface structure before and optionally also after a finishing step with a detection device. The detection device can then provide control signals by means of the activation of individual magnets or magnet groups or else individual ultrasonic devices in order to subject, in a targeted manner, detected ripples or faults of the surface structure to corresponding forces by means of the magnets or ultrasonic devices. Thus, an open-loop or closed-loop control is possible as required.

Further features and advantages of the invention emerge from the claims and the subsequent description of preferred embodiments in conjunction with the drawing. Individual features of the different embodiments shown in the drawing may thus be combined in any manner without exceeding the scope of the present invention.

BRIEF DESCRIPTION OF THE DRAWINGS

The invention will be described in more detail below with the aid of the single FIG. 1. The FIGURE shows, as an embodiment of the invention, the schematic view of the method according to the invention in a band treating line.

FIG. 1 shows the view of the method according to the invention in a band treating line.

DETAILED DESCRIPTION OF THE INVENTION

Before the invention is described in detail, it should be pointed out that it is not restricted to the particular components of the device or to the particular method steps since these components and methods can vary. The terms being used here are only intended to describe special embodiments and are not used in any restricted sense. If, in addition, the singular or indefinite articles are used in the description or in the Claims, these also include a plurality of these elements insofar as the general context does not make it unambiguously clear that something else is intended.

The invention will now be explained in more detail in exemplary manner taken with reference to the accompanying drawings. However, the exemplary embodiments are merely examples which are not intended to limit the inventive concept to a certain arrangement.

FIG. 1 shows the view of the method according to the invention in a band treating line. In FIG. 1, a material band or a material sheet, hereinafter designated material 14, is conveyed by a suitable openable conveying device 1, 1*a* for a reliable material supply into the region of the magnetic field A. The region of the magnetic field A consists of individual magnets 2, 2*a*; 3, 3*a*; 4, 4*a*, arranged next to one another, which are arranged in the material flow direction and are defined hereinafter as at least one magnet group. The material flow direction or material transport direction is indicated in FIG. 1 by an arrow. In the depths of the page and therefore directly behind the at least one magnet group 2, 2*a*; 3, 3*a*; 4, 4*a* are located further magnet groups, which completely take up the entire material width owing to their spatial arrangement.

Once the material 14 has been conveyed by the conveying device 1, 1*a* into the region of the magnetic field A, there is a force-transmitting engagement between the conveying device 1, 1*a* and the material, so the conveying device 1, 1*a* takes over the material transportation through the magnetic field A up to the second conveying device 5, 5*a*. Once the material 14 has left the conveying device 5, 5*a*, the conveying device 5, 5*a* is also connected to the material in force-transmitting manner and the material is located preferably in the spatial centre of the space filled with the magnetic field A. The conveying devices 1, 1*a* and 5, 5*a* take over the material transportation by means of a suitable drive. The conveying devices 1, 1*a* and 5, 5*a* are arranged in such a way that a fixedly defined material running height is preferably ensured in the centre of the magnetic field A at a spacing from the magnets, so contact of the material 14 with the magnetic poles of individual magnet groups 2, 2*a*; 3, 3*a* and 4, 4*a* can be completely ruled out.

The individual magnets of the magnet group 2, 2*a*; 3, 3*a*; 4, 4*a* of the magnetic field A are in each case electrically supplied by suitable electrical control devices 15. Produced by a suitable sequential electrical control device 15 of the individual magnets 2, 2*a*; 3, 3*a* and 4, 4*a* within the at least one magnet group is a travelling magnetic field, which builds up a selective action of force of the respectively connected magnet group inside the magnetic field A in or counter to the material flow direction. This type of force introduction, up to the yield point of the materials, takes place without mechanical contact with the material and leads to the improvement in the ripples in the material. Surface and material defects are thus completely avoided.

In the further embodiment of the invention, directly behind the region of the magnet groups 2, 2*a*; 3, 3*a*; 4, 4*a*, the material is deflected by a deflection roller 6 and conveyed into the region of a first ultrasonic device, which is configured in the embodiment as a roller 8*a*. The deflection roller 6 ensures the maintaining of the material running height and an individual height adjustment, such as, for example, a lowering of the roller 8*a* in the direction of the arrow 7 transverse to the material flow direction to ensure a variable looping angle of the material 14 with the roller 8*a* at all times and to produce a required surface contact between the material 14 and the roller 8*a*. Instead of a roller, differently shaped elements may also be used, if a preferably planar introduction of the sonic energy into the material 14 is possible.

The material 14 is locally and in a targeted manner acted upon by sonic energy by means of the roller 8*a* by the prevailing surface contact in that the sonic energy passes by way of the roller 8*a* and the sound-permeable coating of the roller into the material 14. After the material leaves the region of the roller 8*a*, the material 14 is guided over a roller 8 which is height-adjustable or lowerable individually in the direction of the arrow 7*a* and also ensures, in conjunction with the deflection roller 6*a*, a variable looping angle and a necessary surface contact between the material 14 and the roller 8. In conjunction with the deflection roller 6*a*, the original material running height is produced again.

In a further configuration of the invention, it is provided that the described ultrasonic device 8, 8*a* is used in front of a magnetic field B with the magnet group 10, 10*a*; 11, 11*a*; 12, 12*a*, which is positioned between the conveying devices 9, 9*a* and 13, 13*a*, or else an ultrasonic device 8, 8*a* is placed between at least two magnetic fields A and B. Moreover, it is also provided that the device according to the invention present here only be used with one magnetic field A.

The arrangement may, in addition, have a detection device 16, which is arranged in the FIGURE, for example, in front of and/or behind the magnetic field A. The detection device may, for example, detect the surface structure in an optical manner and convert the detected information into signals for the control device 15. The control device 15 converts these signals into control signals for the at least one magnet group 2, 2*a*; 3, 3*a*; 4, 4*a*; 10, 10*a*; 11, 11*a*; 12, 12*a* and/or the at least one ultrasonic device, in order to introduce, in a targeted manner, the corresponding counter measures, for example to eliminate ripples. Basically, it is also possible once the finishing has taken place, to compare the result of a first treatment with the starting state in order to thereby produce a further open-loop and/or closed-loop signal for a further finishing process.

The method and arrangement can thus either alternatively be operated with magnet groups or in combination with ultrasonic devices in order to carry out a material finishing contactlessly or at least dispensing with levelling rollers. The preferred purpose of use is a use in band treatment or sheet treating lines or processing lines. A further preferred use exists in combination with known levelling machines. The combination and selection of the equipment of the device according to the invention depends on the requirements and special properties of the materials to be processed.

Generally and as a rule, the following alternatives or conceptions are provided for this magnetic stretching and levelling method:

An alternative comprising one magnet group 2, 2*a*; 3, 3*a*; 4, 4*a* for magnetic field A with control device 15 and detection device 16, which magnet group can be operated on its own.

An alternative comprising one magnet group 10, 10*a*; 11, 11*a*; 12, 12*a* for magnetic field B with control device 15 and detection device 16, which magnet group can be operated on its own.

An alternative comprising one magnet group 2, 2*a*; 3, 3*a*; 4, 4*a* for magnetic field A with control device 15 and detection device 16 in connection with an ultrasonic device (6, 6*a*; 7, 7*a*; 8, 8*a*), which alternative can be operated on its own.

An alternative comprising one magnet group 10, 10*a*; 11, 11*a*; 12, 12*a* for magnetic field B with control device 15 and detection device 16 in connection with an ultrasonic device (6, 6*a*; 7, 7*a*; 8, 8*a*), which alternative can be operated on its own.

An alternative comprising a magnet group 2, 2*a*; 3, 3*a*; 4, 4*a* for magnetic field A with control device 15 and detection device 16 in connection with an ultrasonic device (6, 6*a*; 7, 7*a*; 8, 8*a*) and additionally comprising a magnet group 10, 10*a*; 11, 11*a*; 12, 12*a* for magnetic field B with a further control device and a further detection device (not illustrated) which alternative can be operated on its own.

These alternatives can be provided at the same machine simultaneously, but can be driven independently. It is also possible to provide more than two magnetic fields.

The above-described device according to the invention avoids the production of surface and material defects on materials through inadequate frictional engagement with levelling rollers. The device may immediately be electrically adapted to all types of ripples occurring without mechanical changes to the levelling unit being carried out and can also be used for the smallest material thicknesses. The use of the device according to the invention described above substantially increases the production output in material finishings of the most varied sorts.

It is self-evident that this description can be subjected to the most diverse modifications, changes and adaptations which fall within the sphere of equivalents to the attached Claims.

The invention claimed is:

1. A method for improving mechanical properties of a magnetically activatable material for educing ripples in said magnetically activatable material, comprising:

conveying said magnetically activatable material using at least one conveying device through a processing region; and applying a force on said magnetically activatable material in said processing region to deform said magnetically activatable material, the force being contactlessly applied by a plurality of magnets that are arranged in a material flow direction side by side or one behind another, the plurality of magnets forming a magnetic field that is applied in or opposite to the material flow direction, and travels along the plurality of magnets.

2. The method according to claim 1, further comprising sequentially applying electric pulses to the plurality of magnets to form the travelling magnetic field.

3. The method of claim 2, further comprising controlling the plurality of magnets electrically with a variable pulse width.

4. The method according to claim 1, further comprising running the magnetically activatable material through the processing region between mutually opposing magnets at a material running height which remains constant.

5. The method according to claim 1, further comprising disposing the plurality of magnets above and below the magnetically activatable material.

6. The method according to claim 1, further comprising arranging a first conveying device in front of the processing region and a second conveying device behind the processing region, and the first and second conveying devices cooperating in a force-transmitting manner with the magnetically activatable material.

7. The method according to claim 1, further comprising disposing an ultrasonic device at a position that is one of in front of the traveling magnetic field or behind the travelling magnetic field.

8. The method according to claim 1, further comprising disposing an ultrasonic device that is formed by rollers around which the magnetically activatable material is guided.

9. The method according to claim 1, further comprising disposing at least two ultrasonic devices in such a way that sonic energy can be introduced into the magnetically activatable material from an upper material side and from a lower material side.

10. The method according to claim 9, further comprising arranging the at least two ultrasonic devices in such a way that they can be height-adjusted to the upper material side or the lower material side independently of one another transversely to the material flow direction.

11. The method according to claim 1, further comprising disposing an ultrasonic device that introduces sonic energy in a planar manner into the magnetically activatable material.

12. The method according to claim 1, further comprising detecting a surface structure of the magnetically activatable material using at least one detection device, converting the detected surface structure into signals, and converting the signals, by a control device, into control signals for the travelling magnetic field or at least one ultrasonic device.

13. The method according to claim 1, wherein the method is used in band treatment or sheet treatment or processing lines or is used in combination with known levelling machines.

14. The method of claim 1, wherein the plurality of magnets includes two groups of magnets, and the magnetic field travels between the two groups of magnets.

15. The method of claim 14, further comprising disposing an ultrasonic device between the two groups of magnets.

16. The method of claim 1, wherein the magnetic field travels relatively to the magnetically activatable material.

17. An apparatus for improving mechanical properties of a magnetically activatable material for reducing ripples in the magnetically activatable material, comprising:

a conveying device for conveying the magnetically activatable material through a processing region in a material flow direction;

a plurality of magnets arranged side by side or behind one another in the material flow direction along the conveying device, a magnetic field formed thereof contactlessly applying a force to deform the magnetically activatable material conveyed by the conveying device; and a control device connected to each of the plurality of magnets for an individual control of the magnets, wherein the magnetic field is configured to travel along the plurality of magnets, and the force is produced in or opposite to the material flow direction.

18. The apparatus according to dam 17, wherein the magnetically activatable material in the magnetic field has a constant material running height.

19. The apparatus according to claim 17, wherein the plurality of magnets include at least two magnet groups arranged above and below the processing region.

20. The apparatus according to claim 17, wherein the conveying device includes a first conveying device arranged in front of, and a second conveying device arranged behind the processing region, and the first and second conveying devices are connected to the magnetically activatable material in a force-transmitting manner.

21. The apparatus according to claim 17, further comprising an ultrasonic device arranged at a position that is one of in front of and behind the magnetic field.

22. The apparatus according to claim 17, further comprising an ultrasonic device formed by ropers, around which the magnetically activatable material is guided.

23. The apparatus according to claim 17, further comprising at least two ultrasonic devices provided to abut the magnetically activatable material above and below the magnetically activatable material.

24. The apparatus according to claim 23, wherein the at least two ultrasonic devices are height-adjustable and arranged in such a way that they can be fed independently of one another transversely to the material flow direction to an upper side of the magnetically activatable material or a lower side of the magnetically activatable material.

25. The apparatus according to claim 17, further comprising an detection device that is provided to detect a surface structure of the magnetically activatable material, and wherein the control device converts signals detected and converted by the detection device into control signals for the plurality of magnets or the ultrasonic device.

26. The apparatus according to claim 17, wherein the apparatus is used in band treatment or sheet treatment or processing lines or in combination with known levelling machines.

27. The method of claim 1, wherein said magnetically activatable material includes metallic materials.

28. The method of claim 27, wherein the metallic materials include metal bands or metal sheets.

29. The apparatus of claim 17, wherein said magnetically activatable material includes metallic materials.

30. The apparatus of claim 29, wherein the metallic materials include metal bands or metal sheets.

31. The apparatus of claim 17, wherein the plurality of magnets includes two groups of magnets, and the magnetic field travels between the two groups of magnets.

32. The apparatus of claim 31, further comprising an ultrasonic device disposed between the two groups of magnets.

33. The apparatus of claim 17, wherein the magnetic field travels relatively to the magnetically activatable material.

* * * * *